US012188195B2

(12) United States Patent
Van Lerberg et al.

(10) Patent No.: US 12,188,195 B2
(45) Date of Patent: Jan. 7, 2025

(54) ANCHORED WALLED SYSTEM

(71) Applicant: Big Block, Inc, Olathe, KS (US)

(72) Inventors: David P. Van Lerberg, Shawnee, KS (US); David B. Brosseau, Austin, TX (US)

( * ) Notice: Subject to any disclaimer, the term of this patent is extended or adjusted under 35 U.S.C. 154(b) by 0 days.

(21) Appl. No.: 17/028,330

(22) Filed: Sep. 22, 2020

(65) Prior Publication Data

US 2022/0090343 A1 Mar. 24, 2022

(51) Int. Cl.
*E02D 29/02* (2006.01)

(52) U.S. Cl.
CPC ..... *E02D 29/0233* (2013.01); *E02D 29/0241* (2013.01); *E02D 2600/20* (2013.01)

(58) Field of Classification Search
CPC . E02D 29/02; E02D 29/0225; E02D 29/0233; E02D 29/0241; E02D 29/025; E02D 29/0258; E02D 29/0266; E02D 17/205; E02D 2600/20; E04C 1/395
See application file for complete search history.

(56) References Cited

U.S. PATENT DOCUMENTS 4,824,293 A * 4/1989 Brown ..... E02D 29/0241 405/262
5,062,610 A * 11/1991 Woolford ..... E04C 1/395 249/98
5,064,313 A * 11/1991 Risi ..... E02D 29/0241 405/284
5,214,898 A * 6/1993 Beretta ..... E02D 29/0241 405/284
5,353,569 A * 10/1994 Rodrique ..... E04C 1/395 52/589.1
5,622,456 A * 4/1997 Risi ..... E02D 29/025 405/262
6,019,550 A * 2/2000 Wrigley ..... E02D 29/0241 405/262
6,490,837 B1 * 12/2002 Dueck ..... E02D 29/025 52/405.1
6,523,317 B1 * 2/2003 Bott ..... E04C 1/395 256/19

(Continued)

FOREIGN PATENT DOCUMENTS

DE 3920514 A * 1/1991 ..... E02D 29/0225
EP 1408161 A2 * 4/2004 ..... E02D 29/0241
WO WO-0022241 A1 * 4/2000 ..... E02D 29/0241

*Primary Examiner* — Frederick L Lagman
*Assistant Examiner* — Stacy N Lawson
(74) *Attorney, Agent, or Firm* — Arthur K. Shaffer; McDowell, Rice, Smith & Buchanan, P.C.

(57) ABSTRACT

The present invention provides an improved retaining wall system comprising a plurality of wall segments, said system comprising at least one lower wall segment and one upper wall segment, each of said upper and lower wall segments have a top surface, a bottom surface, a rear face, and a fascia, said top surface and said bottom surface extending between said rear face and said fascia, an earthen anchor extending at least partially through each of said wall segments and from said rear face, said earthen anchor configured for extending at least a portion of said vertical load of said retaining wall rearwardly; an interstitial surface; and an interconnecting structure extending into said interstitial surface and between said upper segment and said lower segment.

9 Claims, 8 Drawing Sheets

(56) References Cited

U.S. PATENT DOCUMENTS

| | | | | |
|---|---|---|---|---|
| 2001/0019684 | A1* | 9/2001 | Manthei | E02D 29/025 405/284 |
| 2002/0152709 | A1* | 10/2002 | Gresser | B28B 7/0079 52/604 |
| 2011/0243669 | A1* | 10/2011 | Friederichs | E02D 29/0225 405/284 |
| 2012/0076592 | A1* | 3/2012 | Freitag | E02D 29/0225 405/262 |
| 2012/0199721 | A1* | 8/2012 | Van Lerberg | B28B 7/0014 249/160 |
| 2018/0274196 | A1* | 9/2018 | Amrein | E02D 29/025 |
| 2019/0055712 | A1* | 2/2019 | Smith | E02D 29/0266 |
| 2021/0010220 | A1* | 1/2021 | Ness | E02D 29/025 |

* cited by examiner

ANCHORED WALLED SYSTEM

FIELD OF THE INVENTION

The present invention relates in general to a retaining wall system for use in connection with landscaping, and more specifically to an improved retaining wall system and method for making the masonry block system which may be used as a landscaping supporting element in connection with retaining walls.

BACKGROUND OF THE INVENTION

Landscape retaining walls are currently used in a variety of places for a variety of reasons such as soil retention, protection of structures and for aesthetic effects on commercial, residential, industrial and agriculture facilities. For example, with the development of a commercial facility, an owner may need to build a retaining wall to protect the structure from water damage or from soil erosion associated with the water. However, the facility may have a nonlinear soil contour surrounding the facility. Some retaining wall structures may limit the ability of the retaining wall from adapting to the contour of the surrounding soil. Other's while permitting adjustment, may only provide limited rotation. In addition, many of these retaining wall structures are large and bulky. The ability to contour using wall segments or block sizes which can contour to a surface having a larger curvature or smaller radii would be beneficial.

Over time, many of these retaining walls shift and adjust as the soil expands and contract. As the walls shift, the retaining wall systems become weaker and over time may become dislodged and fall apart. Some prior attempts to provide support to blocks used in retaining walls include using spikes or metal rods which are extended through the wall segments or block. However, these metal rods can corrode and fall apart based on the weather. In addition, the driving a spike or metal rod through the blocks and various wall segments can become broken or weak causing the walls to fail or become weak. Additionally, vertical support in and of itself may be insufficient to adequately secure the blocks or wall segments used in the retaining wall systems. Therefore, there is a need for an improved wall retaining system which provides sufficient support and does not weaken or break the wall segments when used.

Some attempts at reinforcing or retaining the wall support structures include anchors which are used to anchor the block by securing to them to the ground using plastic sheets. The plastic sheets, also known in the industry as geogrid sheets are typically perforated plastic sheets. When used, geogrid sheets are typically placed between a pair of blocks and extend through interstitially through the retaining wall system, where the retaining wall is weaker. In some cases, the geogrid sheet is held in place by an area of limited contact between the adjoining blocks. In some cases, the geogrid sheets can also cause unnecessary voids in the wall and they can interfere with desired contact between the various blocks or wall segments. In addition, it takes time to install the geogrid sheets because the installer needs to first lay the blocks to ensure correct fit and orientation, then they have to remove the blocks and install the geogrid material between successive layers, refitting the blocks afterwards. In some cases the geogrid material must be pulled tight and pinned down during installation because it coils itself up while installing and the installer has to negotiate with the geogrid material to get it to lay down correctly during installation. Therefore, there is a need for use of an earth anchor which is better, easier and quicker to install and which does not interfere or obstruct the block wall segments.

In forming a retaining wall segment, molds are typically used to create a specific retaining wall structure, the form molds being adapted to receive typical masonry materials. Typically, for each specific wall segment for each specific size a new mold is needed. In addition, these molds have limited adaptability and the forms of one wall segment can not be used for another wall segment. Some molds may allow for modification, but they do not allow for a placement of an anchoring structure which is secured directly to the block and which allows for vertical and horizontal support.

In addition, because of the increased use of retaining walls in a variety of locations and situations, it is becoming more popular to provide a support structure with aesthetically pleasing structures. However, customizing each retaining wall support structure typically requires individual molds. In order to have a variety of molds with customized aesthetically pleasing structures would be expensive, numerous and extremely burdensome. There is a need to have support structure which allows for the formation of a block or support wall segment which provides an adaptable mold having a visual surface which is customizable without the need to create a new mold or form would be beneficial.

SUMMARY OF THE INVENTION

In an embodiment of the present invention, the foregoing is addressed by providing an improved retaining wall system comprising a plurality of wall segments wherein said wall segments comprise at least a lower wall segment and an upper wall segment, each of said wall segments comprising a top surface, a bottom surface, a rear face, and a fascia; said top surface and said bottom surface extending between said rear face and said fascia, a first earthen anchor extending at least partially though and from said upper wall segment, a second earthen anchor extending at least partially through and from said lower wall segment, a layered support structure comprising said first earthen anchor and said second earthen anchor with a plurality of particles spaced therebetween, said layered support structure configured for extending at least a portion of said vertical load of said retaining wall rearwardly, an interstitial surface surrounding each of said wall segments; and an interconnecting structure extending between each of said wall segments and into said interstitial surface for rotational alignment of said wall segments whereby said aligned wall segments present a contoured front face.

DETAILED DESCRIPTION

Certain terminology will be used in the following description for convenience in reference only and will not be limiting. For example, top, bottom, front, back, right and left refer to the illustrated embodiment as oriented in the view being referred to. The words "upwardly" and "downwardly" refer to directions up or down and away from, respectively, the geometric center of the embodiment being described and designated parts thereof. Such terminology will include the words specifically mentioned, derivatives thereof and words of similar meaning.

Figure 1:
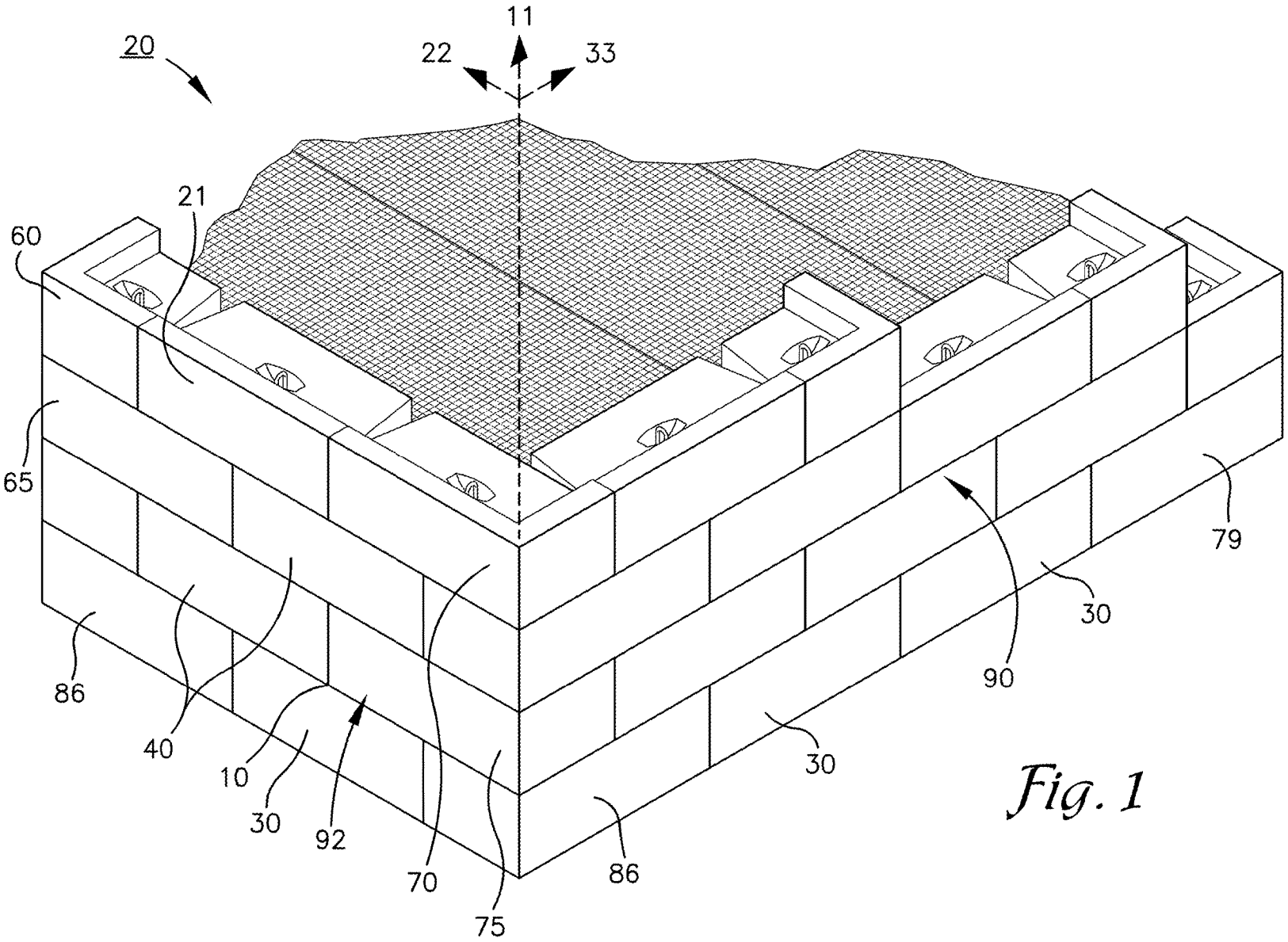
FIG. 1 is a partial cut-away perspective view of an arrangement of a retaining wall with various wall segments in accordance with one embodiment of the present invention.

Referring to FIG. 1, a retaining wall generally referred to with reference numeral 20 having a combination of wall segments spatially arranged with a surrounding interstitial surface 10. The retaining wall 20 includes a plurality of wall segments including at least three of the following, a lower segment 30, an intermediary segment 40, an upper segment 21, a left-walled upper segment 60, a left-walled intermediary segment 65, a left-walled lower segment 69, a right-walled upper segment 70, a right-walled intermediary segment 75, a right-walled lower segment 79, an alternative intermediary segment 83, alternative upper segment 80, an alternative left-walled upper segment 62, and an alternative right-walled upper segment 73. The retaining wall 2 illustrated in FIG. 1 includes a vertically extending front face 90 and a vertically extending side face 92, the front face 90 being angularly oriented to the side face 92. Although the embodiment depicted in FIG. 1 illustrates a generally normal angular orientation between the front face 90 and the side face 92, the angular orientation may vary in magnitude between 0 and 335 degrees depending on the desired contour.

Figure 2:
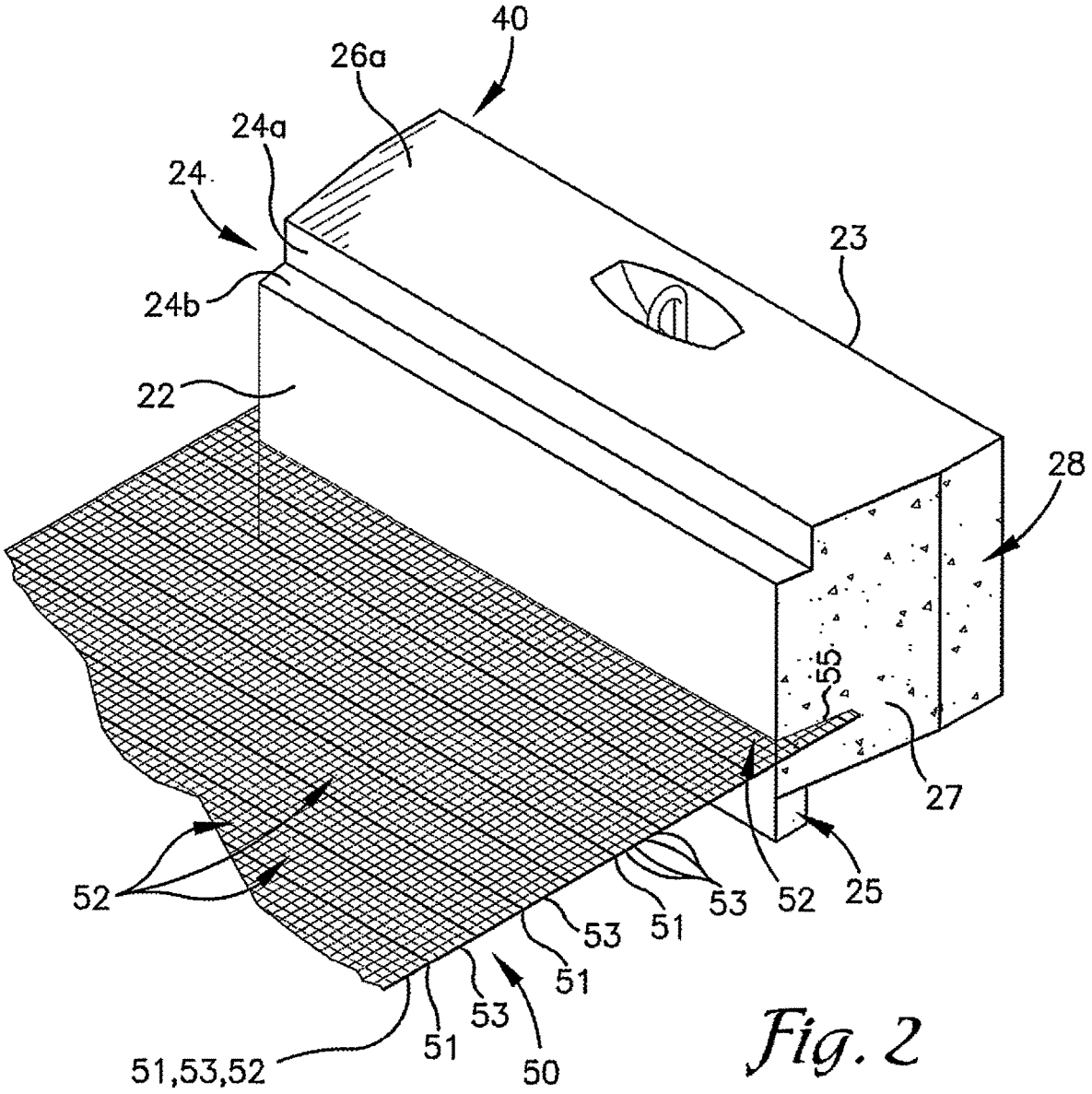
FIG. 2 is a left-side perspective view of an embodiment of a intermediary block with an earth anchor extending rearwardly from the wall segment in accordance with the embodiment depicted in FIG. 1.

As depicted in FIG. 2, each wall segment includes a rear face 22 from which an earthen anchor 50 extends. The rear face 22 is generally spaced opposite a fascia 23 which together with the other walled segments presents the front face 90, also referred to herein as a planar front face. A pair of sides 27 extend from the fascia 23 to the rear face 22. Each walled segment includes a top and a bottom surface **26*a*, 26** which is a least partially planar.

In one embodiment the sides are coplanar with the substantially planar top surface **26*a* and said substantially planar bottom 26*b*. Alternatively, one of the sides 27 may extend from said substantially planar top surface 26*a* a distance for supporting the received wall segment and supporting it in a generally horizontal orientation such as the alternative embodiments illustrated in FIGS. 4, 10**.

The fascia 23 presents a visually appealing surface which is formed during the formation process of the wall segment. The visually appealing surface can be formed using a resilient member using during the formation process.

A masonry façade 28 is depicted in FIG. 2, which extends rearwardly from the fascia 23. The masonry façade 28 allows for a consistent visual appearance of the retaining wall as the wall segment is rotated.

Figure 17:
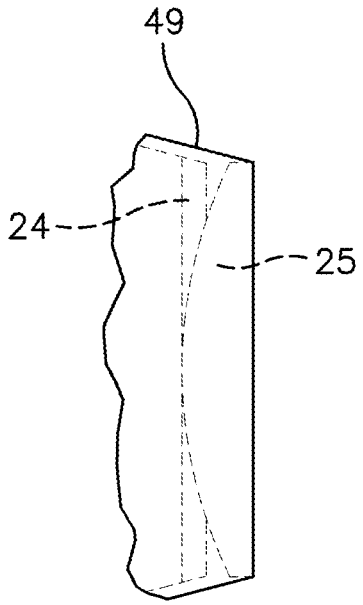
FIG. 17 is a top plan view of a rotational interconnecting structure.

The retaining wall 20 includes a plurality of wall segments with a rotational interconnecting structure 49 illustrated in FIG. 17 which generally extends into the interstitial surface 10 between adjacent wall segments. The interstitial surface 10 is a communication network which surrounds the various wall segments and is presented by the adjacently positioned wall segments which form the retaining wall 20.

As illustrated in FIG. 1, the interstitial surface 10 extends vertically between each horizontally adjacent wall segment and horizontally between each vertically adjacent wall segment. The interstitial surface 10 is presented between the sides 27 and the top and bottom planar surfaces **26*a*, 26*b* of adjacent wall segments. In addition, the interstitial surface 10 is in networked communication throughout the retaining wall 20 so that the interstitial surface 10 adjusts in response to adjustments in each of the wall segment. For example, as the horizontal and vertical wall segments are rotated, moved or aligned, the interstitial surface 10 surrounding the manipulated wall segments varies and the interstitial surface 10 surrounding the non-manipulated wall segments also changes. For example, movement of a pair of proximal wall segments in closer proximity, causes the interstitial surface 10 between the proximal wall segments to shrink. The movement also causes the interstitial surface 10 surrounding a distal wall segment to expand. The change in the interstitial surface 10 is associated with the movement of the proximal wall segments from the distal wall segment. The increase of the interstitial surface 10 surrounding the distal wall segment corresponds to the decrease in the interstitial surface 10** surrounding the proximal wall segments.

Figure 18:
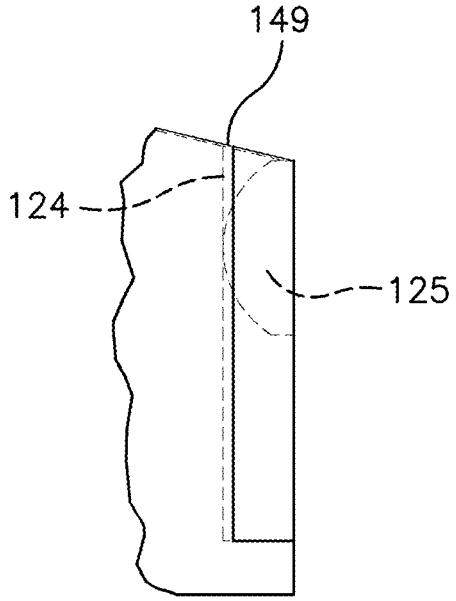
FIG. 18 is a top plan view of an alternative interconnecting structure.
Figure 19:
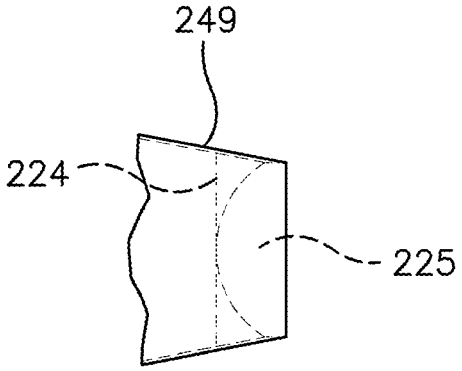
FIG. 19 is a top plan view of a second alternative interconnecting structure.

As further illustrated in FIGS. 17-19, the rotational interconnecting structure 49 includes a downward depending arcuate lip 25 and an upward presenting channel 24. The upward presenting channel 24 is configured for rotational receipt of an adjacent wall segment's downward depending arcuate lip 25. Generally, the downward depending arcuate lip 25 includes a convex arcuate surface which is directed from said rear face 22 towards said fascia 23. As the associated wall segment is rotated, the downward depending arcuate lip 25 rotates within the channel 24. Because the downward depending arcuate lip 25 is generally convex, at least two points of contact of engagement are maintained by the rotational interconnecting structure 49. The downward depending arcuate lip 25 extends downwardly from the substantially planar bottom surface 26*b* and radially inward from the rear face 22 in a convex shape. The upward presenting channel 24 includes a vertical projection 24*a* and a horizontal projection 24*b* joined to the vertical projection 24*a* along an edge. The vertical projection 24*a* is generally consistent with the height of the downward depending arcuate lip 25, so that the rotational interconnecting structure 49 is generally planar or level. However, it may be desirable to provide for a slight angular alignment, which may be helpful to divert water. According to the embodiment of the channel 24 depicted in FIG. 2, the vertical projection 24*a* extends normal from the horizontal projection 24*b*.

The wall segments associated with the upper portion of the retaining wall like the upper segment 21, the left-walled upper segment 60 and the right-walled upper segment 70 include an upwardly extending projection 19. The downward depending arcuate lip 25 extends downwardly from the bottom surface 26*b* and radially from the rear face 22.

The upwardly extending projection 19 extends from the fascia and is vertically separated from the top planar surface 26*a* by a parabolic region 19*a*. The parabolic region 19*a* extends rearwardly from the upwardly extending projection 19 to the top planar surface 26*a*. The upwardly extending projection 19 and the parabolic region 19*a* present a retaining structure for receiving the plurality of particles 54 providing for an embankment on the backside of the retaining wall 20 opposite the front face 90. The received particles provide for a counterweight to the retaining wall 20, helping to maintain the structure in a vertically upright manner and retain the particles 54 on the backside thereof.

The intermediary wall segments, such as the intermediary segment 40, the left-walled intermediary segment 65 and the right-walled intermediary segment 75 extend from the fascia 23 to the rear face 22 with a pair of sides 27. The channel 24 extends from the top planar surface 26*a* near the rear face 22 and the downward depending arcuate lip 25 extends downwardly from the bottom surface 26*b* and radially from the rear face 22.

An alternative downwardly depending lip 125 is illustrated in FIGS. 4-5, 10-11 and a second alternative downwardly depending lip 225 is illustrated in FIGS. 13-16. The alternative downwardly depending lip 125 has an increased curvature for greater rotation of the wall segment and is illustrated in association with the left-walled and right-walled wall segments. The alternative downwardly depending lip 125 includes an offset arcuate region 125*a* spaced along one side 27 and configured for receipt by an alternative channel 124. The alternative channel 124 extends from one 27 side and terminates at a spacer 125*b*. The spacer 125*b* has complementary shape and size to support a side of the overlying wall segment providing stability during rotation. Together, the alternative downwardly depending lip 125 and the alternative channel 124 form an alternative rotational interconnecting structure 149 as illustrated in FIG. 18 which allows for rotation of a first wall segment about a second wall segment while maintaining constant engagement between at least two points of contact.

Figure 13:
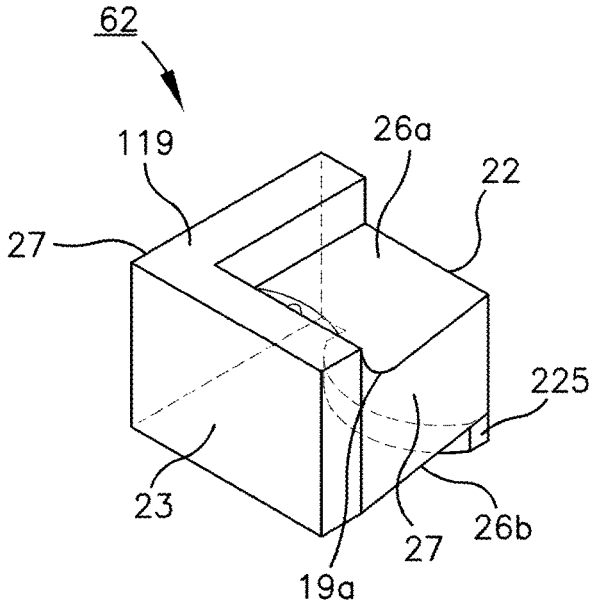
FIG. 13 is a top perspective view of an alternative embodiment of a left walled upper segment as shown in FIG. 1, with a partially arcuate surface in phantom line on the underside thereof.

A second rotational interconnected structure 249 is illustrated in FIG. 19, with a second alternative downwardly depending lip 225 and a second alternative channel 224. The second alternative downwardly depending lip 225 has an increased curvature which allows for greater rotation of the wall segment and is illustrated in association with the alternative left-walled and alternative right-walled wall segments. The second alternative downwardly depending lip 225 includes a circular sector which extends towards the fascia 23 from the rear face 22. The second alternative downwardly depending lip 225 is configured for receipt by the second alternative channel 224. As depicted in FIG. 13, the second alternative downwardly depending lip 225 is offset from the center of the depicted wall segment, the alternative left-walled upper segment 62. The second alternative interconnected structure 249 allows for rotation of a first wall segment about a second wall segment while maintaining constant engagement between a plurality of contact points.

An abatement 29 is presented behind the fascia 23 along the top planar surface 26*a*. The abatement 29 extends downwardly from the top planar surface 26*a* with a circumscribing sidewall. In one embodiment the abatement 29 receives a connecting structure for lifting and placement of the desired wall segment.

Figure 8:
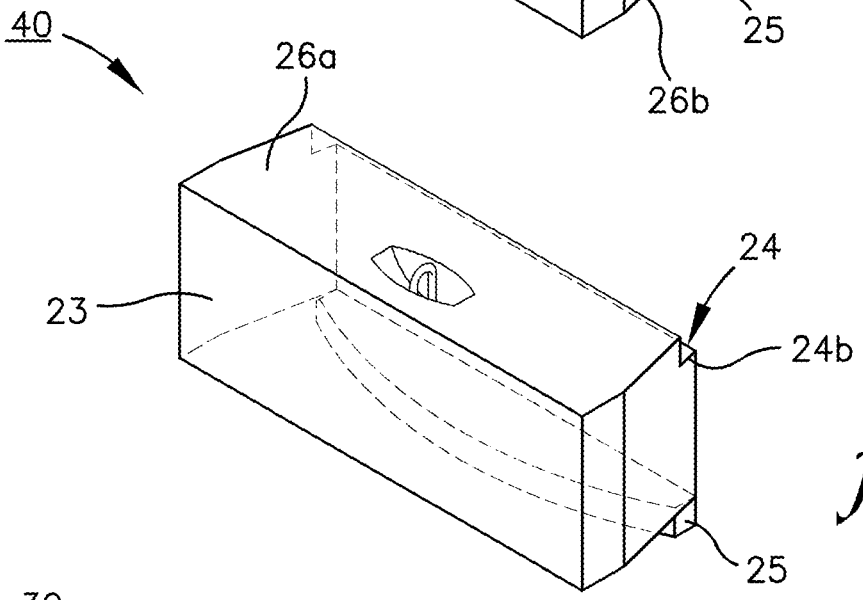
FIG. 8 top perspective view of an embodiment of a intermediary wall segment as shown in FIG. 1, the intermediary wall segment having an arcuate surface in phantom line on the underside thereof.

An embodiment of the intermediary segment 40 is depicted in FIGS. 2, 8. Generally, the intermediary segment 40 is configured for supporting and rotationally receiving the upper segment 21 and for rotational receipt and support by the lower segment 30. The intermediary segment 40 extends rearwardly from the facia 23 to the rear face 22, from the top planar surface 26*a* to the bottom planar surface 26*b*. The intermediary segment 40 also includes the upward presenting channel 24 and a downwardly depending lip 25 associated with the rear face 22. In addition, the intermediary segment 40 includes the abatement 29 located near the fascia 23. In addition, the masonry fascia 28 extending at least partially along the side 27 from the fascia 23 towards the rear face 22. The earthen anchor 50 is depicted as extending rearwardly from the rear face 22.

Figure 4:
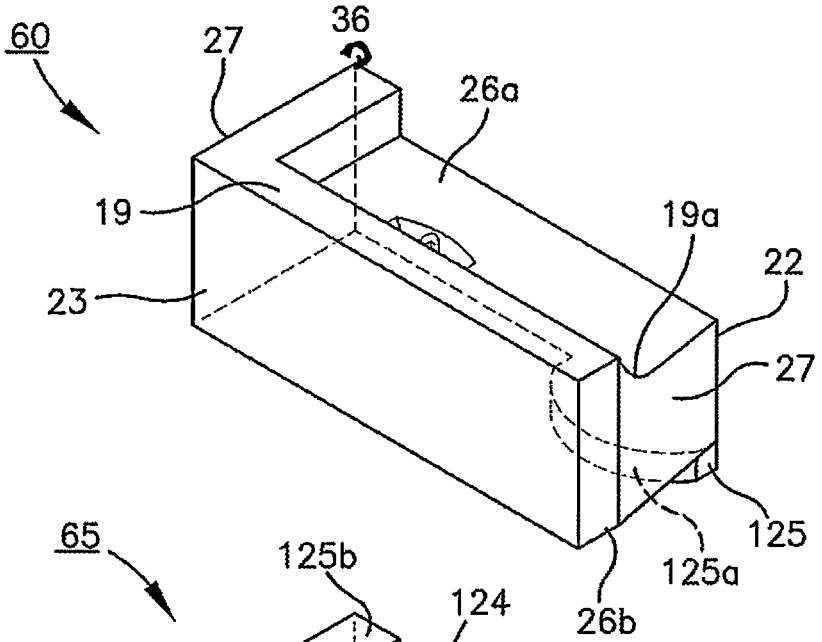
FIG. 4 is a top perspective view of an embodiment of a left walled upper segment as shown in FIG. 1, the left walled upper segment having a partially arcuate surface in phantom line on the underside thereof.

An embodiment of the left-walled upper segment 60 is depicted in FIG. 4. Generally, the left-walled upper segment 60 is configured for support and rotational receipt by the left-walled intermediary segment 65 or the left-walled lower segment 69. The left-walled upper segment 60 extends rearwardly from the facia 23 to the rear face 22, from the top planar surface 26*a* to the bottom planar surface 26*b*. The left-walled upper segment 60 includes the alternative downwardly depending lip 125 associated with the rear face 22. In addition, the left-walled upper segment 60 includes the upwardly extending projection 19 which wraps around from the facia 23 to the side 27. The upwardly extending projection 19 is vertically separated from the top planar surface 26*a* along the facia 23 by the parabolic region 19*a*.

Figure 5:
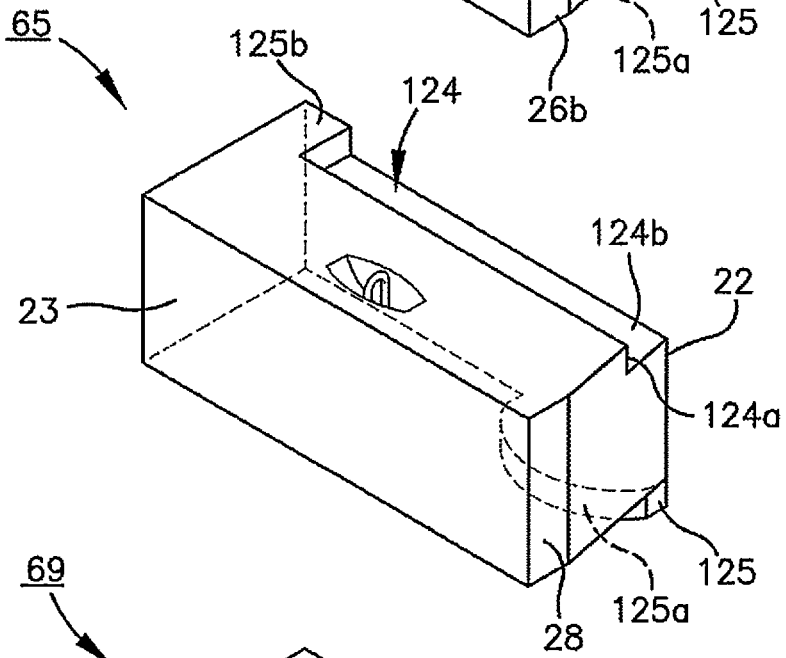
FIG. 5 is a top perspective view of an embodiment of a left walled intermediary segment as shown in FIG. 1, the left walled intermediary segment having a partially arcuate surface in phantom line on the underside thereof.

An embodiment of the left-walled intermediary segment 65 is depicted in FIG. 5. Generally, the left-walled intermediary segment 65 is configured for supporting and rotationally receiving the left-walled upper segment 60 and for rotational receipt and support by the left-walled lower segment 69. The left-walled intermediary segment 65 extends rearwardly from the facia 23 to the rear face 22, from the top planar surface 26*a* to the bottom planar surface 26*b*. The left-walled intermediary segment 65 also includes the alternative upwardly presenting channel 124 and the alternative downwardly depending lip 125 associated with the rear face 22. As depicted in FIG. 5, the alternative upwardly presenting channel 124 extends partially along the rear face 22. The abatement 29 is illustrated in FIG. 5 along the top planar surface 26*a* near the fascia 23. The masonry fascia 28 is illustrated as extending at least partially along the side 27 from the fascia 23 towards the rear face 22.

Figure 6:
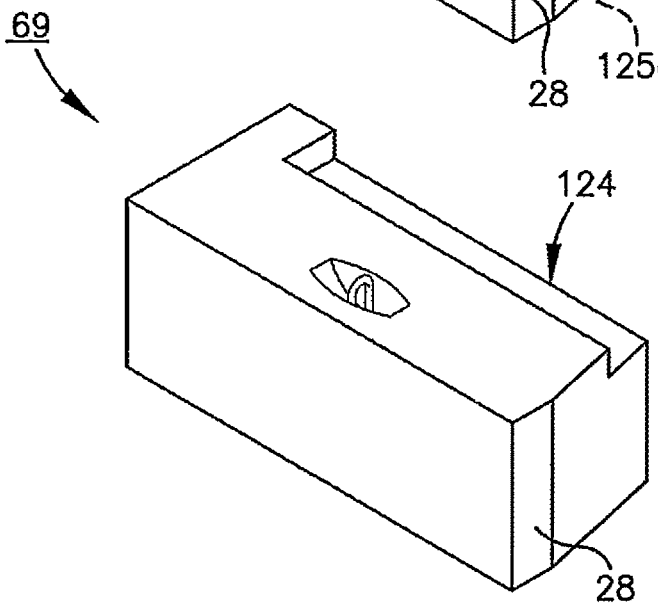
FIG. 6 is a rear perspective view of an embodiment of a left walled lower segment as shown in FIG. 1.

An embodiment of the left-walled lower segment 69 is depicted in FIG. 6. Generally, the left-walled lower segment 69 is configured for supporting and rotationally receiving the left-walled upper segment 60 or the left-walled intermediary segment 65. The left-walled lower segment 69 extends rearwardly from the facia 23 to the rear face 22, from the top planar surface 26*a* to the bottom planar surface 26*b*. The left-walled lower segment 69 also includes the alternative upwardly presenting channel 124 associated with the rear face 22. As depicted in FIG. 6, the alternative upwardly presenting channel 124 extends partially along the rear face 22. The abatement 29 is illustrated in FIG. 6 along the top planar surface 26*a* near the fascia 23. The masonry fascia 28 is illustrated as extending at least partially along the side 27 from the fascia 23 towards the rear face 22.

Figure 7:
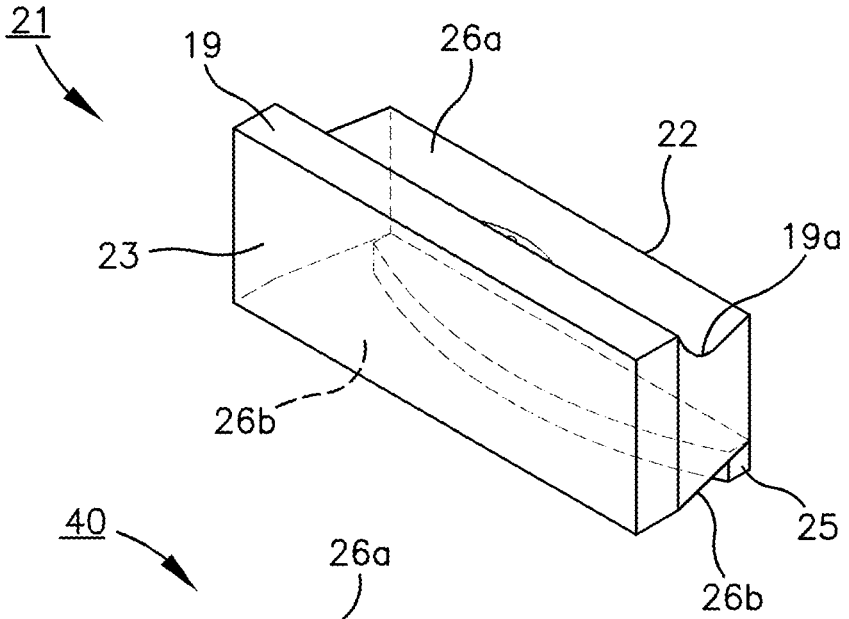
FIG. 7 is a top perspective view of an embodiment of a top wall segment as shown in FIG. 1, the top wall segment having an arcuate surface in phantom line on the underside thereof.

An embodiment of the upper segment 21 is depicted in FIG. 7. The upper segment 21 extends rearwardly from the facia 23 to the rear face 22, from the top planar surface 26*a* to the bottom planar surface 26*b*. The upper segment 21 includes the downwardly depending lip 25 associated with the rear face 22. In addition, the upper segment 21 includes the upwardly extending projection 19 which extends from the facia 23. The upwardly extending projection 19 is vertically separated from the top planar surface 26*a* by the parabolic region 19*a*.

Figure 9:
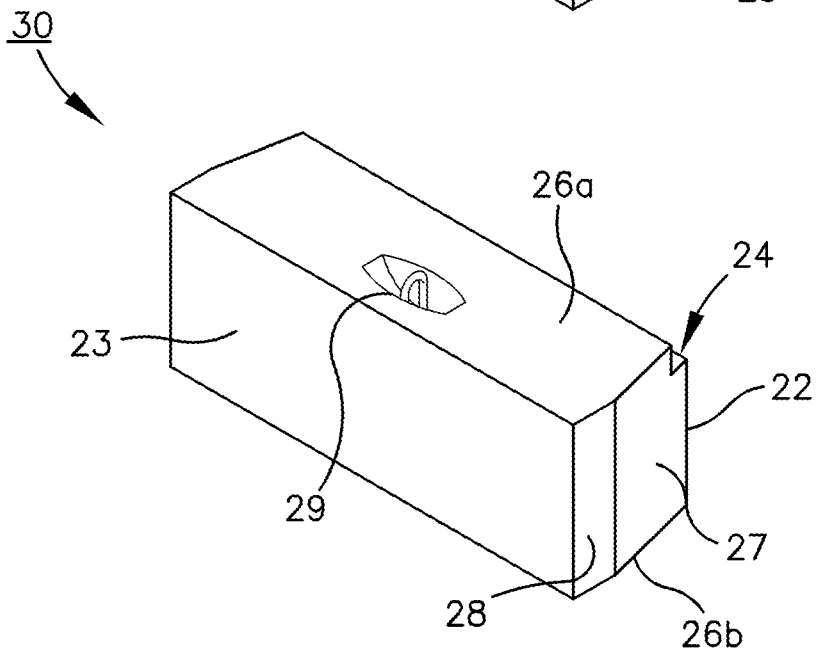
FIG. 9 is a top perspective view of a lower wall segment as shown in FIG. 1.

An embodiment of the lower segment 30 is depicted in FIG. 9. Generally, the lower segment 30 is configured for rotational receipt of the intermediary segment 40 or the upper segment 21. The lower segment 30 extends rearwardly from the facia 23 to the rear face 22, from the top planar surface 26*a* to the bottom planar surface 26*b*. The lower segment 30 also includes the upwardly presenting channel 24 associated with the rear face 22. As depicted in FIG. 9, the upwardly presenting channel 24 extends along the rear face 22. The abatement 29 is illustrated in FIG. 9 along the top planar surface 26*a* near the fascia 23. The masonry fascia 28 is illustrated as extending at least partially along the side 27 from the fascia 23 towards the rear face 22.

Figure 10:
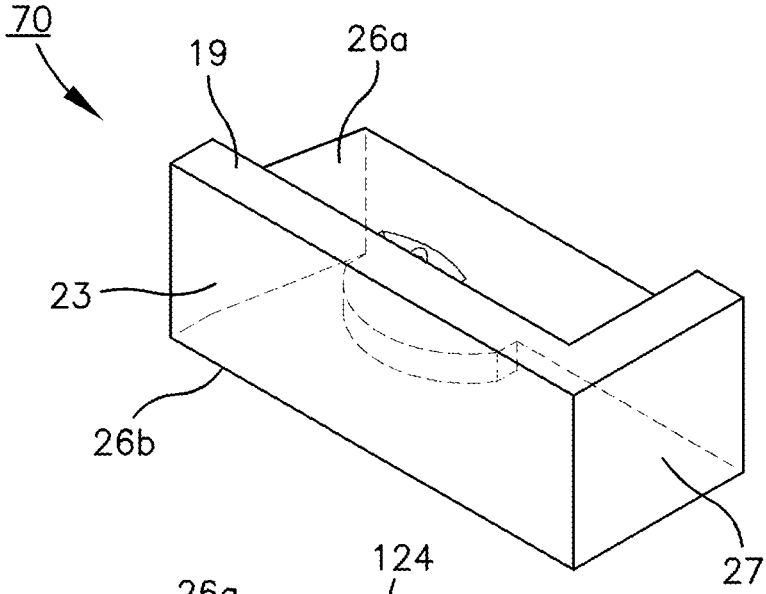
FIG. 10 is a top perspective view of a right walled upper segment as shown in FIG. 1, the right walled upper segment having a partially arcuate surface in phantom line on the underside thereof.

An embodiment of the right-walled upper segment 70 is depicted in FIG. 10. Generally, the right-walled upper segment 70 is configured for rotational receipt and support by the right-walled intermediary segment 75 and the right-walled lower segment 79. The right-walled upper segment 70 extends rearwardly from the facia 23 to the rear face 22, from the top planar surface 26*a* to the bottom planar surface 26*b*. The right-walled upper segment 70 includes the alternative downwardly depending lip 125 associated with the rear face 22. In addition, the right-walled upper segment 70 includes the upwardly extending projection 19 which wraps around from the facia 23 to the side 27. The upwardly extending projection 19 is vertically separated from the top planar surface 26*a* along the facia 23 by the parabolic region (not shown).

Figure 11:
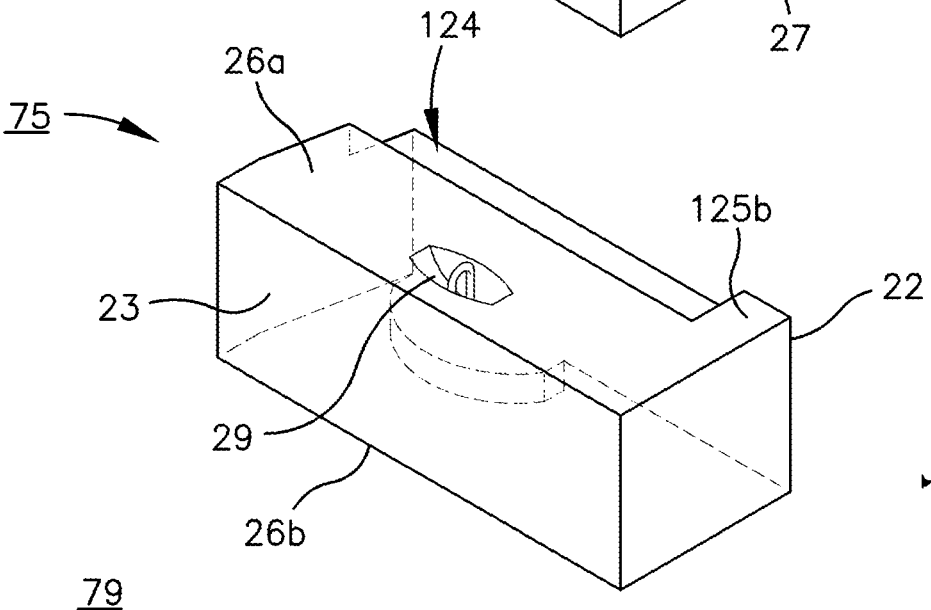
FIG. 11 is a top perspective view of a right wall intermediary segment as shown in FIG. 1, the right walled intermediary segment having a partially arcuate surface in phantom line on the underside thereof.

An embodiment of the right-walled intermediary segment 75 is depicted in FIG. 11. Generally, the right-walled intermediary segment 75 is configured for supporting and rotationally receiving the right-walled upper segment 70 and for rotational receipt and support by the right-walled lower segment 79. The right-walled intermediary segment 75 extends rearwardly from the facia 23 to the rear face 22, from the top planar surface 26*a* to the bottom planar surface 26*b*. The right-walled intermediary segment 75 also includes the alternative upwardly presenting channel 124 and the alternative downwardly depending lip 125 associated with the rear face 22. As depicted in FIG. 11, the alternative upwardly presenting channel 124 extends partially along the rear face 22. The abatement 29 is illustrated in FIG. 5 along the top planar surface 26*a* near the fascia 23. The spacer 125*b* extends between the alternative upwardly presenting channel 124 and the side 27 with complementary shape and size of the downwardly depending lip associated with an overlying wall segment such as a right-walled upper segment 70. Generally, the spacer 125*b* provides sufficient support for receiving the overlying wall segment and providing stability and maintain engagement during rotation and while at rest.

Figure 12:
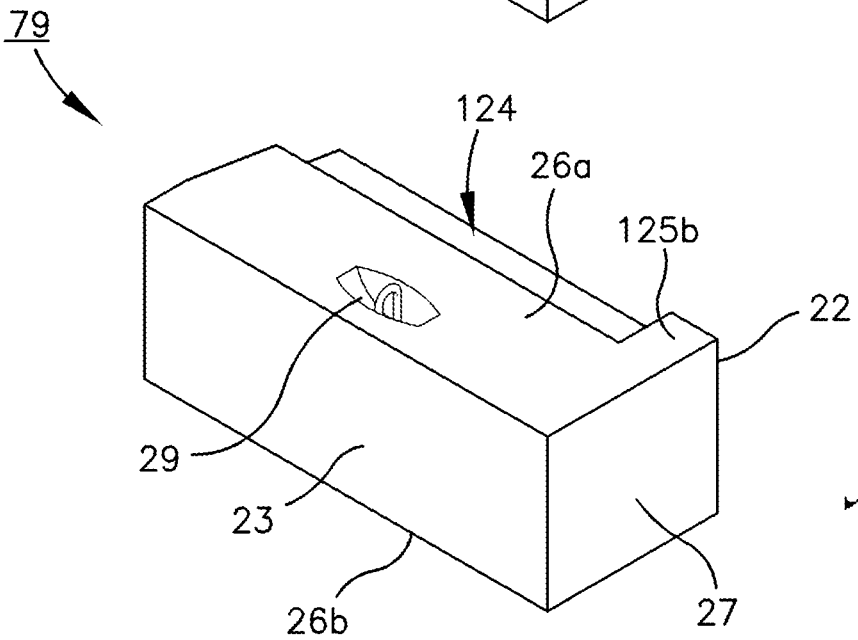
FIG. 12 is a top perspective view of a right walled lower segment as shown in FIG. 1.

An embodiment of the right-walled lower segment 79 is depicted in FIG. 12. The right-walled lower segment 79 extends rearwardly from the facia 23 to the rear face 22, from the top planar surface 26*a* to the bottom planar surface 26*b*. The right-walled lower segment 79 also includes the alternative upwardly presenting channel 124 associated with the rear face 22. As depicted in FIG. 12, the alternative upwardly presenting channel 124 extends partially along the rear face 22. The abatement 29 is illustrated in FIG. 12 along the top planar surface 26*a* near the fascia 23. The spacer 125*b* extends between the alternative upwardly presenting channel 124 and the side 27 with complementary shape and size for supporting an overlying wall segment such as a right-walled intermediary wall segment 75 or right-walled upper wall segment 70. Generally, the right-walled lower segment 79 can receive and support a right-walled intermediary wall segment 75 or a right-walled upper wall segment 70.

Another embodiment of a walled wall segment is illustrated in FIG. 13 with an alternative left-walled upper segment 62. Generally, the alternative left-walled upper segment 62 is configured for rotational receipt and support by an alternative intermediary segment 83 and an alternative lower segment (not shown). The alternative left-walled upper segment 62 extends rearwardly from the facia 23 to the rear face 22, from the top planar surface 26*a* to the bottom planar surface 26*b*. The alternative left-walled upper segment 62 includes the second alternative downwardly depending lip 225 centrally offset and associated with the rear face 22. In addition, the alternative left-walled upper segment 62 includes an alternative upwardly extending projection 119 which wraps around from the facia 23 to the side 27. The alternative upwardly extending projection 119 is vertically separated from the top planar surface 26*a* along the facia 23 by the parabolic region 19*a*.

Figure 14:
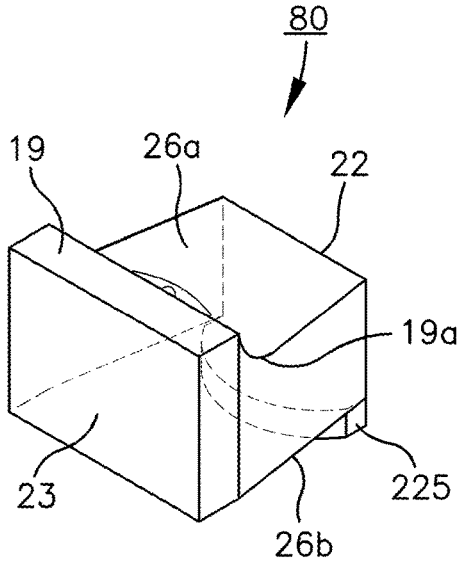
FIG. 14 is a top perspective view of an alternative embodiment of a upper wall segment in accordance with an alternative embodiment, the upper wall segment having a partially arcuate surface in phantom line on the underside thereof.

Another embodiment of a walled wall segment is illustrated in FIG. 14 with an alternative embodiment of an alternative upper segment 80. Generally, the alternative upper segment 80 is configured for rotational receipt and support by an alternative intermediary segment 83 and an alternative lower segment (not shown). The alternative upper segment 80 extends rearwardly from the facia 23 to the rear face 22, from the top planar surface 26*a* to the bottom planar surface 26*b*. The alternative upper segment 80 includes the second alternative downwardly depending lip 225 centrally offset on the rear face 22 opposite the fascia 23. In addition, the alternative upper segment 80 includes an upwardly extending projection 19. The upwardly extending projection 19 is vertically separated from the top planar surface 26*a* along the facia 23 by the parabolic region 19*a*.

Figure 15:
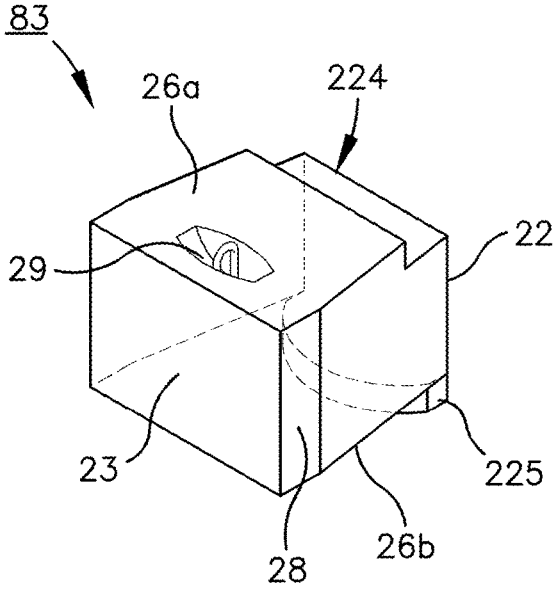
FIG. 15 is a top perspective view of an alternative embodiment of an intermediary wall segment in accordance with an alternative embodiment, the alternative intermediary wall segment having a partially arcuate surface in phantom line on the underside thereof.

Another embodiment of a walled wall segment is illustrated in FIG. 15 with an alternative embodiment of the intermediary segment 83. Generally, the alternative intermediary segment 83 is configured for supporting and rotationally receiving one of the alternative upper segments, such as the alternative 80, the alternative left-walled upper segment 62 or the alternative right-walled upper segment 73. In addition, the alternative intermediary segment 83 is configured for rotational receipt and support by a lower segment (not shown). The alternative intermediary segment 83 extends rearwardly from the facia 23 to the rear face 22, from the top planar surface 26*a* to the bottom planar surface 26*b*. The alternative intermediary segment 83 also includes a second alternative upwardly presenting channel 224 and the second alternative downwardly depending lip 225 centrally offset along the rear face 22. The second alternative downwardly depending lip 225 is generally spaced opposite the fascia 23. In addition, the alternative intermediary segment 83 includes the abatement 29 located near the fascia 23. In addition, the masonry fascia 28 extending at least partially along the side 27 from the fascia 23 towards the rear face 22.

Figure 16:
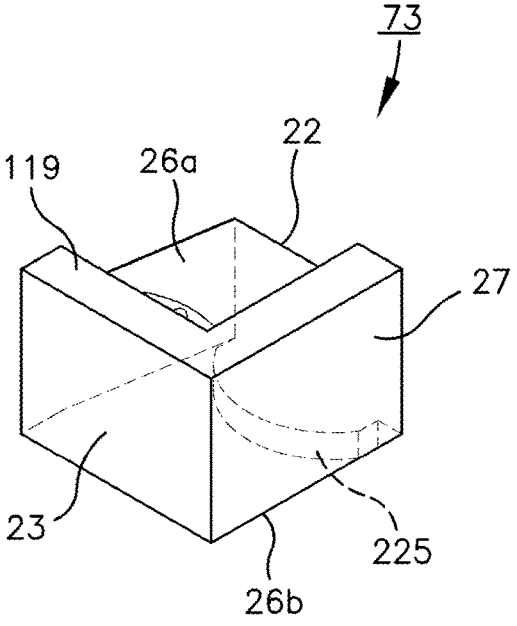
FIG. 16 is a top perspective view of an alternative embodiment of a right walled upper segment as shown in FIG. 1, the alternative right walled upper segment having a partially arcuate surface in phantom line on the underside thereof.

Another embodiment of a walled wall segment is illustrated in FIG. 16 with an alternative right-walled upper segment 73. Generally, the alternative right-walled upper segment 73 is configured for rotational receipt and support by an alternative intermediary segment 83 and an alternative lower segment (not shown). The alternative right-walled upper segment 73 extends rearwardly from the facia 23 to the rear face 22, from the top planar surface 26*a* to the bottom planar surface 26*b*. The alternative right-walled upper segment 73 includes the second alternative downwardly depending lip 225 centrally offset the rear face 22 and opposite the fascia 23. In addition, the alternative right-walled upper segment 73 includes an alternative upwardly extending projection 119 which wraps around from the facia 23 to the side 27. The alternative upwardly extending projection 119 is vertically separated from the top planar surface 26*a* along the facia 23 by the parabolic region (not shown).

Figure 3:
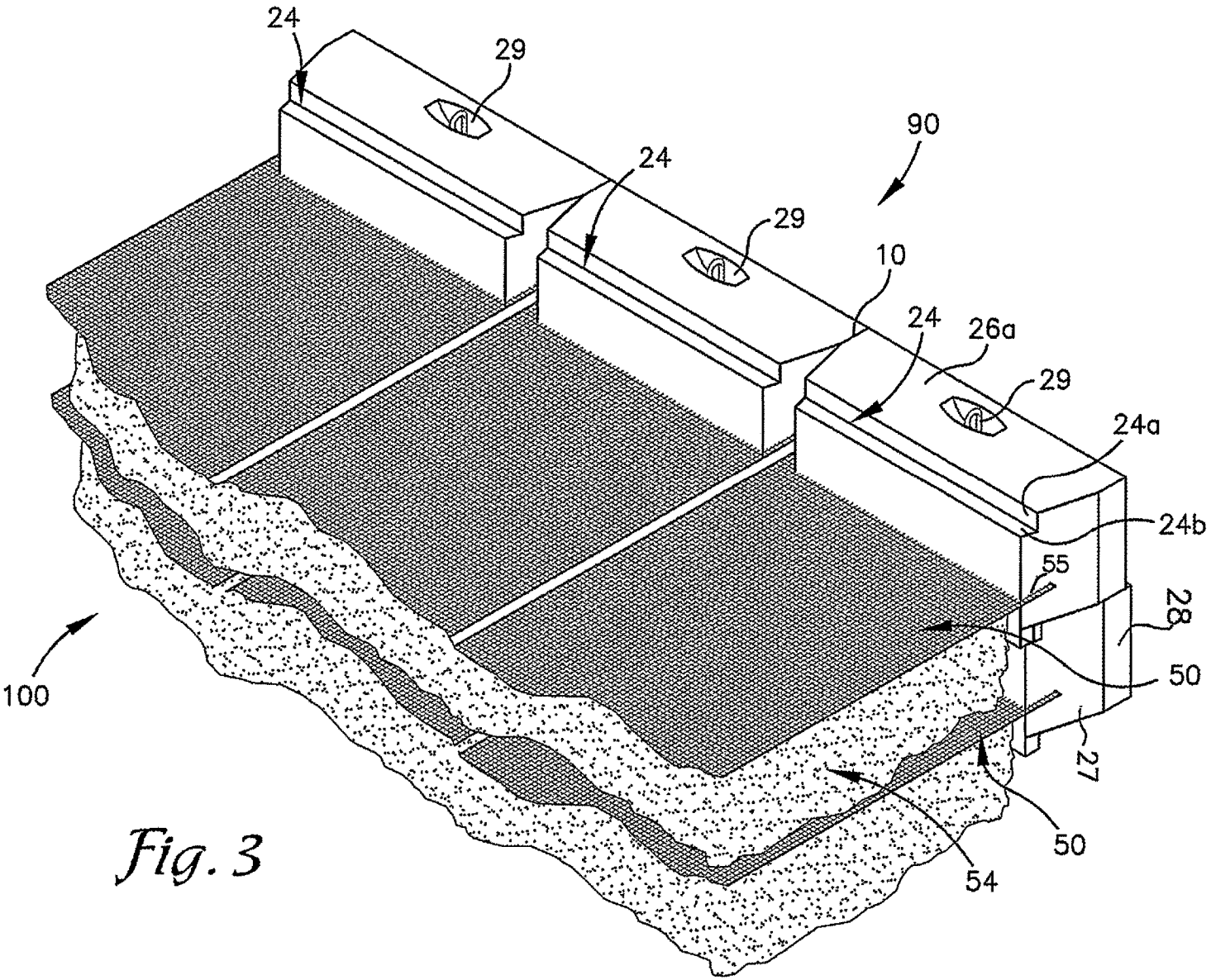
FIG. 3 is a rear perspective view of a section of the retaining wall with the stacked wall segments, the earth anchor extending rearwardly in accordance with the embodiment depicted in FIG. 1.

The earthen anchor 50 depicted in FIGS. 1-3 presents a generally planar structure which extends from a rear face 22 associated with the intermediary wall segment 40. One end of the earthen anchor 50 may be encapsulated within the associated wall segment, and configured for rearward extension from the rear face 22. Alternatively, one end of the earthen anchor 50 may be grouped together with, for example, a band (not shown) and the grouped end (not shown) inserted into a channel (not shown) formed in the wall segment.

The earthen anchor 50 generally provides a horizontal structure which provides improved support and load distribution of the supported wall segment. The earthen anchor 50 depicted in FIGS. 2-3 is generally a woven material with interconnected elongated strands 53 and bands 51 which presents channels 52 for receiving particles. Generally, the impregnated earthen anchor 50 extends at least partially through and rearwardly from the rear face 22 of the walled segment and as depicted extends approximately midway between the top planar surface 26*a* and the bottom planar surface 26*b*. The channels 52 provide openings into which particles 54 such as soil or gravel can recede and overlay, reinforcing and strengthening the in-plane torsional rigidity, flexural modulus, shear force resistance and load distribution of the supported load. The earthen anchor 50 generally converts the load of the vertically extending wall segment, horizontally rearwardly into the supporting ground surface. By extending the earthen anchor 50 from a plurality of stacked wall segments, a layered support structure 100 is presented, the layered support structure 100 extending rearwardly from the front face 90 and providing improved support and load distribution for the retaining wall 20.

An embodiment of the layered support structure 100 is depicted in FIG. 3 with a plurality of earthen anchors 50 separated by a layer of particles 54. The layered support structure 100 provides rearward support for the retaining wall 20 and maintains the front face 90 in a vertically extending upright manner.

The fascia 23 presents a visually appealing surface which is formed during the formation process of the wall segment. The visually appealing surface can be formed using a resilient member using during the formation process.

As illustrated in FIG. 1, plural wall segments are positioned and arranged in relation to an upright axis 11 associated with the retaining wall 2 and normal to a horizontal support axis 22 extending rearwardly from the retaining wall along the earthen anchor 50. The wall segments including the lower segment 30, the intermediary segment 40, the upper segment 21, the left-walled upper segment 60, the left-walled intermediary segment 65, the left-walled lower segment 69, the right-walled upper segment 70, the right-walled intermediary segment 75 and the right-walled lower segment 79, the alternative intermediary segment 83, alternative upper segment 80, the alternative left-walled upper segment 62, and the alternative right-walled upper segment 73 are vertically and horizontally arranged with the rotational interconnecting structure 49, 149, 249 having an downwardly depending structure 25, 125, 225 and an upward receiving structure 24, 124, 224 which are adapted for engagement and rotation of the vertically arranged wall segments 30, 40, 21, 60, 65, 69, 70, 75, 79, 83, 80, 62, 73 in at least two points of contact.

In general, the rotational interconnecting structure provides for rotation of an overlying block, such as the first block 10, about a rotational axis 36 of an underlying block, such as the second block 20. The rotational axis 36 may have the same orientation as the retaining wall upright axis 34 as illustrated in FIG. 1 or it may vary depending on the underlying block. In general, the overlying block may include, but is not limited to, the first or second blocks 10, 20 while the underlying block may generally include, but is not limited to, the second or third blocks 20, 30. The retaining wall includes the first block 10 overlying the second block 20, the second block 20 overlying the third block 30, with additional optional layers of the second block 20 overlying another second block 20 in the preferred configuration of the retaining wall 2.

In FIG. 3 an illustration of the upper structure 50*a* includes a depending lip 52 which is shown associated with the rear surface 16, having a non-linear outwardly facing edge 54 and extending from a bottom surface 17 of the masonry block 10. The non-linear edge 54 provides for rotation of the block 10 about the rotational axis 36 (shown in FIG. 4) allowing the block 10 to adjust to the contour of the earth surface 4 or other rear facing landscaping surfaces.

Although the non-linear edge 54 is indicated as being arcuate, the edge may have alternative configurations which provide for the rotation of the masonry block 10 about the rotational axis 36.

Another illustration of the interlocking structure 50 is depicted in FIG. 4 in which the lower structure 50*b* is illustrated as being associated with the upper surface 28 and presenting an inwardly facing edge 60 on the second block 20. A recessed portion 58 is adapted for receiving the depending lip 52 at a zone of contact 56 illustrated in FIG. 1A. The zone of contact 56 provides for the rotation of the first block 10 about the rotational axis 36 of the second block 20, the zone of contact 56 being located at the junction of the inwardly facing edge 60 and the outwardly facing edge 54 illustrated in FIG. 3, the zone of contact 56 extending along the width of the inwardly facing edge 60.

When the first and second masonry blocks 10, 20 are collectively arranged in FIGS. 10 and 11, the underlying, second block 20 contains the rotational axis 36 around which the overlying first block 10 may be rotated. FIG. 10 illustrates the blocks vertically aligned. The first and second blocks 10, 20 are rotated in FIG. 11, with the depending lip 52 of the first block 10 engaging the recessed portion 58 of the second block 20. The first block 10 is rotated about the rotational axis 36 of the second block 20 while the depending lip 52 of the first block 10 is secured within the recessed portion 58 of the second block 20. In this manner, the masonry blocks 10, 20 may form the retaining wall 2 generally having a curvature which may vary 60 degrees of rotation along the rotational axis 36 of the second block 20 generally between −30 to 30 degrees from the retaining wall's upright axis 34.

It should be understood that while certain forms of this invention have been illustrated and described, it is not limited thereto except insofar as such limitations are included in the following claims.

What is claimed and desired to be secured by Letters Patent:

1. An improved retaining wall system comprising:

a plurality of monolithic wall segments including at least a monolithic lower wall segment and a monolithic upper wall segment each comprising a pair of sides each extending between a front face and a rear face;

said monolithic upper wall segment being rotationally received by said monolithic lower wall segment with a rotational interconnecting structure;

said rotational interconnecting structure comprising a parabolic shaped arcuate lip configured for rotational receipt by an open-ended channel while maintaining at least two points of contact;

a first earthen anchor having an end encapsulated directly within and extending at least partially through said monolithic upper wall segment;

a second earthen anchor having an end encapsulated directly within and extending at least partially through said monolithic lower wall segment;

wherein each of said first and second earthen anchors present a planar structure which extends laterally through at least one of said pair of sides and through said rear face along a horizontal plane; and said first earthen anchor and said second earthen anchor configured to form a layered support structure configured to resist rotation and distribute a supported load rearwardly.

2. The improved retaining wall system of claim 1 wherein said encapsulated end of said first earthen anchor and said second earthen anchor presents a plurality of interconnected elongated strands.

3. The improved retaining wall system of claim 2 wherein said plurality of monolithic wall segments further comprises a right-walled upper segment and a right-walled lower segment whereby said right-walled upper segment is rotatable about said right-walled lower segment.

4. The improved retaining wall system of claim 1 wherein said arcuate lip is offset from a center of said rear face.

5. The improved retaining wall system of claim 1 further comprising an intermediary wall segment configured for receiving said monolithic upper wall segment and for being received by said monolithic lower wall segment, said intermediary wall segment having an upwardly presenting channel and a downwardly depending arcuate lip.

6. The improved retaining wall system of claim 1 wherein said first earthen anchor is in communication with said second earthen anchor with a plurality of particles to stabilize said front faces.

7. An improved retaining wall system comprising:

a plurality of monolithic wall segments including at least a monolithic lower wall segment and a monolithic upper wall segment, each monolithic wall segment comprising a pair of sides extending between a front face and a rear face, a rotational interconnecting structure extending between said monolithic upper wall segment and said monolithic lower wall segment; and a first earthen anchor having an end encapsulated directly within and extending at least partially through said rear face and at least one of said pair of sides of one of said monolithic wall segments along a horizontal plane.

8. The improved retaining wall system of claim 7 further comprising a second earthen anchor having an end encapsulated directly within and extending at least partially through at least one of said pair of sides of another of said monolithic wall segments wherein said first earthen anchor and said second earthen anchor are configured to form a layered support structure which is configured to resist rotation.

9. A method of forming an improved retaining wall comprising:

forming a plurality of monolithic wall segments using molds including at least a monolithic lower wall segment and a monolithic upper wall segment each comprising a fascia, a rear face and a side surface extending therebetween presenting a rotational interconnecting structure between said monolithic upper wall segment and said monolithic lower wall segment;

angularly extending a masonry façade between said fascia and said side surface associated with at least one of said monolithic wall segments wherein said masonry façade presents a consistent visual appearance with said fascia;

directly encapsulating a first earthen anchor at least partially within at least one of said monolithic wall segments, whereby said first earthen anchor extends at least partially through said rear surface and said side surface, whereby said first earthen anchor is configured to resist rotation and distribute a supported load rearwardly; and surrounding said monolithic wall segments with an interstitial space which adjusts in response to rotation of said monolithic wall segment.

* * * * *